US010397686B2

(12) United States Patent
Förstner et al.

(10) Patent No.: US 10,397,686 B2
(45) Date of Patent: Aug. 27, 2019

(54) DETECTION OF MOVEMENT ADJACENT AN EARPIECE DEVICE

(71) Applicant: BRAGI GmbH, München (DE)

(72) Inventors: Friedrich Christian Förstner, München (DE); Martin Steiner, München (DE); Engin Çağatay, München (DE); Nikolaj Hviid, München (DE); Peter Vincent Boesen, München (DE)

(73) Assignee: BRAGI GmbH, Müchen (DE)

( * ) Notice: Subject to any disclaimer, the term of this patent is extended or adjusted under 35 U.S.C. 154(b) by 0 days.

(21) Appl. No.: 15/674,770

(22) Filed: Aug. 11, 2017

(65) Prior Publication Data

US 2018/0048954 A1 Feb. 15, 2018

Related U.S. Application Data

(60) Provisional application No. 62/375,337, filed on Aug. 15, 2016.

(51) Int. Cl.
*H04R 1/10* (2006.01)

(52) U.S. Cl.
CPC ..... *H04R 1/1041* (2013.01); *H04R 1/1016* (2013.01); *H04R 2420/07* (2013.01)

(58) Field of Classification Search
CPC . H04R 1/1041; H04R 1/1016; H04R 2420/07
See application file for complete search history.

(56) References Cited

U.S. PATENT DOCUMENTS

| | | | |
|---|---|---|---|
| 2,325,590 | A | 8/1943 | Carlisle et al. |
| 2,430,229 | A | 11/1947 | Kelsey |
| 3,047,089 | A | 7/1962 | Zwislocki |
| D208,784 | S | 10/1967 | Sanzone |

(Continued)

FOREIGN PATENT DOCUMENTS

| | | | |
|---|---|---|---|
| CN | 204244472 | U | 4/2015 |
| CN | 104683519 | A | 6/2015 |

(Continued)

OTHER PUBLICATIONS

Akkermans, "Acoustic Ear Recognition for Person Identification", Automatic Identification Advanced Technologies, 2005 pp. 219-223.

(Continued)

*Primary Examiner* — Andrew L Sniezek
(74) *Attorney, Agent, or Firm* — Goodhue, Coleman & Owens, P.C.

(57) ABSTRACT

An earpiece includes an earpiece housing, a processor disposed within the housing and a sensor system associated with the earpiece housing, the sensor system operatively connected to the processor. The sensor system is configured to detect skin touches proximate the earpiece housing. The sensor system may include an emitter and a detector which may be a light emitters/light detectors or other types of emitters and detectors. The skin touches may be skin touches on an ear of the housing while the earpiece is positioned within the ear. The earpiece may further include a speaker and wherein the earpiece provides audio feedback through the speaker in response to the skin touches.

17 Claims, 9 Drawing Sheets

(56) References Cited

U.S. PATENT DOCUMENTS 3,586,794 A 6/1971 Michaelis
3,934,100 A 1/1976 Harada
3,983,336 A 9/1976 Malek et al.
4,069,400 A 1/1978 Johanson et al.
4,150,262 A 4/1979 Ono
4,334,315 A 6/1982 Ono et al.
D266,271 S 9/1982 Johanson et al.
4,375,016 A 2/1983 Harada
4,588,867 A 5/1986 Konomi
4,617,429 A 10/1986 Bellafiore
4,654,883 A 3/1987 Iwata
4,682,180 A 7/1987 Gans
4,791,673 A 12/1988 Schreiber
4,852,177 A 7/1989 Ambrose
4,865,044 A 9/1989 Wallace et al.
4,984,277 A 1/1991 Bisgaard et al.
5,008,943 A 4/1991 Amdt et al.
5,185,802 A 2/1993 Stanton
5,191,602 A 3/1993 Regen et al.
5,201,007 A 4/1993 Ward et al.
5,201,008 A 4/1993 Arndt et al.
D340,286 S 10/1993 Seo
5,280,524 A 1/1994 Norris
5,295,193 A 3/1994 Ono
5,298,692 A 3/1994 Ikeda et al.
5,343,532 A 8/1994 Shugart
5,347,584 A 9/1994 Narisawa
5,363,444 A 11/1994 Norris
D367,113 S 2/1996 Weeks
5,497,339 A 3/1996 Bernard
5,606,621 A 2/1997 Reiter et al.
5,613,222 A 3/1997 Guenther
5,654,530 A 8/1997 Sauer et al.
5,692,059 A 11/1997 Kruger
5,721,783 A 2/1998 Anderson
5,748,743 A 5/1998 Weeks
5,749,072 A 5/1998 Mazurkiewicz et al.
5,771,438 A 6/1998 Palermo et al.
D397,796 S 9/1998 Yabe et al.
5,802,167 A 9/1998 Hong
D410,008 S 5/1999 Almqvist
5,929,774 A 7/1999 Charlton
5,933,506 A 8/1999 Aoki et al.
5,949,896 A 9/1999 Nageno et al.
5,987,146 A 11/1999 Pluvinage et al.
6,021,207 A 2/2000 Puthuff et al.
6,054,989 A 4/2000 Robertson et al.
6,081,724 A 6/2000 Wilson
6,084,526 A 7/2000 Blotky et al.
6,094,492 A 7/2000 Boesen
6,111,569 A 8/2000 Brusky et al.
6,112,103 A 8/2000 Puthuff
6,157,727 A 12/2000 Rueda
6,167,039 A 12/2000 Karlsson et al.
6,181,801 B1 1/2001 Puthuff et al.
6,208,372 B1 3/2001 Barraclough
6,230,029 B1 5/2001 Yegiazaryan et al.
6,275,789 B1 8/2001 Moser et al.
6,339,754 B1 1/2002 Flanagan et al.
D455,835 S 4/2002 Anderson et al.
6,408,081 B1 6/2002 Boesen
6,424,820 B1 7/2002 Burdick et al.
D464,039 S 10/2002 Boesen
6,470,893 B1 10/2002 Boesen
D468,299 S 1/2003 Boesen
D468,300 S 1/2003 Boesen
6,542,721 B2 4/2003 Boesen
6,560,468 B1 5/2003 Boesen
6,654,721 B2 11/2003 Handelman
6,664,713 B2 12/2003 Boesen
6,690,807 B1 2/2004 Meyer
6,694,180 B1 2/2004 Boesen
6,718,043 B1 4/2004 Boesen
6,738,485 B1 5/2004 Boesen
6,748,095 B1 6/2004 Goss
6,754,358 B1 6/2004 Boesen et al.
6,784,873 B1 8/2004 Boesen et al.
6,823,195 B1 11/2004 Boesen
6,852,084 B1 2/2005 Boesen
6,879,698 B2 4/2005 Boesen
6,892,082 B2 5/2005 Boesen
6,920,229 B2 7/2005 Boesen
6,952,483 B2 10/2005 Boesen et al.
6,987,986 B2 1/2006 Boesen
7,010,137 B1 3/2006 Leedom et al.
7,113,611 B2 9/2006 Leedom et al.
D532,520 S 11/2006 Kampmeier et al.
7,136,282 B1 11/2006 Rebeske
7,203,331 B2 4/2007 Boesen
7,209,569 B2 4/2007 Boesen
7,215,790 B2 5/2007 Boesen et al.
D549,222 S 8/2007 Huang
D554,756 S 11/2007 Sjursen et al.
7,403,629 B1 7/2008 Aceti et al.
D579,006 S 10/2008 Kim et al.
7,463,902 B2 12/2008 Boesen
7,508,411 B2 3/2009 Boesen
D601,134 S 9/2009 Elabidi et al.
7,825,626 B2 11/2010 Kozisek
7,965,855 B1 6/2011 Ham
7,979,035 B2 7/2011 Griffin et al.
7,983,628 B2 7/2011 Boesen
D647,491 S 10/2011 Chen et al.
8,095,188 B2 1/2012 Shi
8,108,143 B1 1/2012 Tester
8,140,357 B1 3/2012 Boesen
D666,581 S 9/2012 Perez
8,300,864 B2 10/2012 Müllenborn et al.
8,406,448 B2 3/2013 Lin
8,436,780 B2 5/2013 Schantz et al.
D687,021 S 7/2013 Yuen
8,719,877 B2 5/2014 VonDoenhoff et al.
8,767,987 B2 * 7/2014 Fretz ..... H04R 25/50 381/312
8,774,434 B2 7/2014 Zhao et al.
8,831,266 B1 9/2014 Huang
8,891,800 B1 11/2014 Shaffer
8,994,498 B2 3/2015 Agrafioti et al.
D728,107 S 4/2015 Martin et al.
9,013,145 B2 4/2015 Castillo et al.
9,037,125 B1 5/2015 Kadous
D733,103 S 6/2015 Jeong et al.
9,081,944 B2 7/2015 Camacho et al.
9,510,159 B1 11/2016 Cuddihy et al.
D773,439 S 12/2016 Walker
D775,158 S 12/2016 Dong et al.
D777,710 S 1/2017 Palmborg et al.
D788,079 S 5/2017 Son et al.
2001/0005197 A1 6/2001 Mishra et al.
2001/0027121 A1 10/2001 Boesen
2001/0043707 A1 11/2001 Leedom
2001/0056350 A1 12/2001 Calderone et al.
2002/0002413 A1 1/2002 Tokue
2002/0007510 A1 1/2002 Mann
2002/0010590 A1 1/2002 Lee
2002/0030637 A1 3/2002 Mann
2002/0046035 A1 4/2002 Kitahara et al.
2002/0057810 A1 5/2002 Boesen
2002/0076073 A1 6/2002 Taenzer et al.
2002/0118852 A1 8/2002 Boesen
2003/0002705 A1 1/2003 Boesen
2003/0065504 A1 4/2003 Kraemer et al.
2003/0100331 A1 5/2003 Dress et al.
2003/0104806 A1 6/2003 Ruef et al.
2003/0115068 A1 6/2003 Boesen
2003/0125096 A1 7/2003 Boesen
2003/0218064 A1 11/2003 Conner et al.
2004/0070564 A1 4/2004 Dawson et al.
2004/0160511 A1 8/2004 Boesen
2005/0017842 A1 1/2005 Dematteo
2005/0043056 A1 2/2005 Boesen
2005/0094839 A1 5/2005 Gwee
2005/0125320 A1 6/2005 Boesen
2005/0148883 A1 7/2005 Boesen

(56) References Cited

U.S. PATENT DOCUMENTS

2005/0165663 A1 7/2005 Razumov
2005/0196009 A1 9/2005 Boesen
2005/0251455 A1 11/2005 Boesen
2005/0266876 A1 12/2005 Boesen
2006/0029246 A1 2/2006 Boesen
2006/0073787 A1 4/2006 Lair et al.
2006/0074671 A1 4/2006 Farmaner et al.
2006/0074808 A1 4/2006 Boesen
2006/0166715 A1 7/2006 Engelen et al.
2006/0166716 A1 7/2006 Seshadri et al.
2006/0220915 A1 10/2006 Bauer
2006/0258412 A1 11/2006 Liu
2008/0076972 A1 3/2008 Dorogusker et al.
2008/0090622 A1 4/2008 Kim et al.
2008/0146890 A1 6/2008 LeBoeuf et al.
2008/0254780 A1 10/2008 Kuhl et al.
2008/0255430 A1 10/2008 Alexandersson et al.
2009/0003620 A1 1/2009 McKillop et al.
2009/0008275 A1 1/2009 Ferrari et al.
2009/0017881 A1 1/2009 Madrigal
2009/0073070 A1 3/2009 Rofougaran
2009/0097689 A1 4/2009 Prest et al.
2009/0105548 A1 4/2009 Bart
2009/0191920 A1 7/2009 Regen et al.
2009/0245559 A1 10/2009 Boltyenkov et al.
2009/0261114 A1 10/2009 McGuire et al.
2009/0296968 A1 12/2009 Wu et al.
2010/0033313 A1 2/2010 Keady et al.
2010/0203831 A1 8/2010 Muth
2010/0210212 A1 8/2010 Sato
2010/0320961 A1 12/2010 Castillo et al.
2011/0140844 A1 6/2011 McGuire et al.
2011/0239497 A1 10/2011 McGuire et al.
2011/0286615 A1 11/2011 Olodort et al.
2012/0057740 A1 3/2012 Rosal
2013/0316642 A1 11/2013 Newham
2013/0346168 A1 12/2013 Zhou et al.
2014/0079257 A1 3/2014 Ruwe et al.
2014/0106677 A1 4/2014 Altman
2014/0122116 A1 5/2014 Smythe
2014/0153768 A1 6/2014 Hagen et al.
2014/0163771 A1 6/2014 Demeniuk
2014/0185828 A1 7/2014 Helbling
2014/0219467 A1 8/2014 Kurtz
2014/0222462 A1 8/2014 Shakil et al.
2014/0235169 A1 8/2014 Parkinson et al.
2014/0270227 A1 9/2014 Swanson
2014/0270271 A1 9/2014 Dehe et al.
2014/0335908 A1 11/2014 Krisch et al.
2014/0348367 A1 11/2014 Vavrus et al.
2015/0028996 A1 1/2015 Agrafioti et al.
2015/0110587 A1 4/2015 Hori
2015/0148989 A1 5/2015 Cooper et al.
2015/0245127 A1 8/2015 Shaffer
2016/0033280 A1 2/2016 Moore et al.
2016/0072558 A1 3/2016 Hirsch et al.
2016/0073189 A1 3/2016 Lindén et al.
2016/0125892 A1 5/2016 Bowen et al.
2016/0166203 A1* 6/2016 Goldstein ..... A61B 5/6817 600/301
2016/0360350 A1 12/2016 Watson et al.
2017/0013360 A1 1/2017 Hviid
2017/0059152 A1 3/2017 Hirsch et al.
2017/0060262 A1 3/2017 Hviid et al.
2017/0060269 A1 3/2017 Förstner et al.
2017/0061751 A1 3/2017 Loermann et al.
2017/0062913 A1 3/2017 Hirsch et al.
2017/0064426 A1 3/2017 Hviid
2017/0064428 A1 3/2017 Hirsch
2017/0064432 A1 3/2017 Hviid et al.
2017/0064437 A1 3/2017 Hviid et al.
2017/0078780 A1 3/2017 Qian et al.
2017/0105622 A1 4/2017 Boesen et al.
2017/0108918 A1 4/2017 Boesen
2017/0109131 A1 4/2017 Boesen
2017/0110124 A1 4/2017 Boesen et al.
2017/0110899 A1 4/2017 Boesen
2017/0111723 A1 4/2017 Boesen
2017/0111725 A1 4/2017 Boesen et al.
2017/0111726 A1 4/2017 Martin et al.
2017/0111740 A1 4/2017 Hviid et al.
2017/0111834 A1 4/2017 Belverato
2017/0113057 A1* 4/2017 Goodall ..... A61N 2/006
2017/0139668 A1 5/2017 Steiner
2017/0151447 A1 6/2017 Boesen
2017/0151668 A1 6/2017 Boesen
2017/0151918 A1 6/2017 Boesen
2017/0151930 A1 6/2017 Boesen
2017/0151956 A1 6/2017 Boesen
2017/0151957 A1 6/2017 Boesen
2017/0151959 A1 6/2017 Boesen
2017/0153114 A1 6/2017 Boesen
2017/0153636 A1 6/2017 Boesen
2017/0154532 A1 6/2017 Boesen
2017/0155985 A1 6/2017 Boesen
2017/0155992 A1 6/2017 Perianu et al.
2017/0155993 A1 6/2017 Boesen
2017/0155997 A1 6/2017 Boesen
2017/0155998 A1 6/2017 Boesen
2017/0156000 A1 6/2017 Boesen
2017/0178631 A1 6/2017 Boesen
2017/0180842 A1 6/2017 Boesen
2017/0180843 A1 6/2017 Perianu et al.
2017/0180897 A1 6/2017 Perianu
2017/0188127 A1 6/2017 Perianu et al.
2017/0188132 A1 6/2017 Hirsch et al.
2017/0195829 A1 7/2017 Belverato et al.
2017/0208393 A1 7/2017 Boesen
2017/0214987 A1 7/2017 Boesen
2017/0215016 A1 7/2017 Dohmen et al.
2017/0230752 A1 8/2017 Dohmen et al.
2017/0257694 A1 9/2017 Boesen
2017/0257698 A1 9/2017 Boesen et al.
2017/0257717 A1 9/2017 Milevski et al.

FOREIGN PATENT DOCUMENTS

CN 104837094 A 8/2015
EP 1469659 A1 10/2004
EP 1017252 A3 5/2006
EP 2903186 A1 8/2015
GB 2074817 4/1981
GB 2508226 A 5/2014
JP 06292195 10/1998
WO 2008103925 A1 8/2008
WO 2007034371 A3 11/2008
WO 2011001433 A2 1/2011
WO 2012071127 A1 5/2012
WO 2013134956 A1 9/2013
WO 2014046602 A1 3/2014
WO 2014043179 A3 7/2014
WO 2015061633 A2 4/2015
WO 2015110577 A1 7/2015
WO 2015110587 A1 7/2015
WO 2016032990 A1 3/2016

OTHER PUBLICATIONS

Announcing the $3,333,333 Stretch Goal (Feb. 24, 2014).
Ben Coxworth: "Graphene-based ink could enable low-cost, foldable electronics", "Journal of Physical Chemistry Letters", Northwestern University, (May 22, 2013).
Blain: "World's first graphene speaker already superior to Sennheiser MX400", htt://www.gizmag.com/graphene-speaker-beats-sennheiser-mx400/31660, (Apr. 15, 2014).
BMW, "BMW introduces BMW Connected—The personalized digital assistant", "http://bmwblog.com/2016/01/05/bmw-introduces-bmw-connected-the-personalized-digital-assistant", (Jan. 5, 2016).
BRAGI Is on Facebook (2014).
BRAGI Update—Arrival of Prototype Chassis Parts—More People—Awesomeness (May 13, 2014).
BRAGI Update—Chinese New Year, Design Verification, Charging Case, More People, Timeline(Mar. 6, 2015).

(56) References Cited

OTHER PUBLICATIONS

BRAGI Update—First Sleeves From Prototype Tool—Software Development Kit (Jun. 5, 2014).
BRAGI Update—Let's Get Ready to Rumble, A Lot to Be Done Over Christmas (Dec. 22, 2014).
BRAGI Update—Memories From April—Update on Progress (Sep. 16, 2014).
BRAGI Update—Memories from May—Update on Progress—Sweet (Oct. 13, 2014).
BRAGI Update—Memories From One Month Before Kickstarter—Update on Progress (Jul. 10, 2014).
BRAGI Update—Memories From the First Month of Kickstarter—Update on Progress (Aug. 1, 2014).
BRAGI Update—Memories From the Second Month of Kickstarter—Update on Progress (Aug. 22, 2014).
BRAGI Update—New People @BRAGI—Prototypes (Jun. 26, 2014).
BRAGI Update—Office Tour, Tour to China, Tour to CES (Dec. 11, 2014).
BRAGI Update—Status on Wireless, Bits and Pieces, Testing—Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back to China, Backer Day, on Track(May 16, 2015).
BRAGI Update—Beta2 Production and Factory Line(Aug. 20, 2015).
BRAGI Update—Certifications, Production, Ramping Up, (Nov. 13, 2015).
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2015).
BRAGI Update—On Track, Design Verification, How It Works and What's Next(Jul. 15, 2015).
BRAGI Update—On Track, On Track and Gems Overview, (Jun. 24, 2015).
BRAGI Update—Status on Wireless, Supply, Timeline and Open House@BRAGI(Apr. 1, 2015).
BRAGI Update—Unpacking Video, Reviews on Audio Perform and Boy Are We Getting Close(Sep. 10, 2015).
Healthcare Risk Management Review, "Nuance updates computer-assisted physician documentation solution" (Oct. 20, 2016).
Hoyt et. al., "Lessons Learned from Implementation of Voice Recognition for Documentation in the Military Electronic Health Record System", The American Health Information Management Association (2017).
Hyundai Motor America, "Hyundai Motor Company Introduces a Health + Mobility Concept for Wellness in Mobility", Fountain Valley, Californa (2017).
International Search Report & Written Opinion, PCT/EP2016/070231 (dated Nov. 18, 2016).
Last Push Before the Kickstarter Campaign Ends on Monday 4pm CET (Mar. 28, 2014).
Nigel Whitfield: "Fake tape detectors, 'from the stands' footie and UGH? Internet of Things in my set-top box"; http://www.theregister.co.uk/2014/09/24/ibc_round_up_object_audio_dlna_iot/ (Sep. 24, 2014).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for the Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).
Wikipedia, "Gamebook", https://en.wikipedia.org/wiki/Gamebook, Sep. 3, 2017, 5 pages.
Wikipedia, "Kinect", "https://en.wikipedia.org/wiki/Kinect", 18 pages, (Sep. 9, 2017).
Wikipedia, "Wii Balance Board", "https://en.wikipedia.org/wiki/Wii_Balance_Board", 3 pages, (Jul. 20, 2017).

* cited by examiner

DETECTION OF MOVEMENT ADJACENT AN EARPIECE DEVICE

PRIORITY STATEMENT

This application claims priority to U.S. Provisional Patent Application 62/375,337, filed on Aug. 15, 2016, and entitled Detection of movement adjacent an earpiece device, hereby incorporated by reference in its entirety.

FIELD OF THE INVENTION

The present invention relates to wearable devices. More particularly, but not exclusively, the present invention relates to ear pieces.

BACKGROUND

Natural and user friendly interfaces are desirable, particularly for wearable devices. What is needed are new and improved apparatus, methods, and systems for wearable devices which allow for natural and user friendly interactions.

SUMMARY

Therefore, it is a primary object, feature, or advantage of the present invention to improve over the state of the art.

It is a further object, feature, or advantage of the present invention to provide a wearable device that captures skin touches.

It is a still further object, feature, or advantage of the present invention to use skin touches to provide user input.

Another object, feature, or advantage is to monitor and classify skin touches.

Yet another object, feature, or advantage is to provide greater accuracy and reliability of input modality A still further object, feature, or advantage is to provide greater range of options for movements, gestures including three dimensional or complex movement.

Another object, feature, or advantage is to provide a user interface for a wearable device that permits a wider area of input than a wearable device surface.

Yet another object, feature, or advantage is to provide a user interface for a wearable device that provides for multi-touch input.

One or more of these and/or other objects, features, or advantages of the present invention will become apparent from the specification and claims that follow. No single embodiment need provide each and every object, feature, or advantage. Different embodiments may have different objects, features, or advantages. Therefore, the present invention is not to be limited to or by an objects, features, or advantages stated herein.

According to one aspect, an earpiece includes an earpiece housing, a processor disposed within the housing and a sensor system associated with the earpiece housing, the sensor system operatively connected to the processor. The sensor system is configured to detect skin touches proximate the earpiece housing. The sensor system may include an emitter and a detector which may be a light emitters/light detectors or other types of emitters and detectors. The skin touches may be skin touches on an ear of the housing while the earpiece is positioned within the ear. The earpiece may further include a speaker and wherein the earpiece provides audio feedback through the speaker in response to the skin touches. Alternatively, feedback may be otherwise provided such as thermal feedback or other type of feedback. The processor provides for interpreting the skin touches. The skin touches may be interpreted as indicative of an emotion, as indicative of a medical condition, or as a command. The skin touches may be performed by a person other than a user wearing the earpiece. The skin touches may be associated with physiological measurements. In addition, the sensor system is further configured to detect gestures proximate the earpiece housing, the gestures not touching skin.

According to another aspect, a method for receiving user input at an earpiece is provided. The method may include emitting energy from the earpiece, detecting reflections of the energy at the earpiece, analyzing the reflections to determine the reflection are indicative of a skin touch, and using the skin touch to provide the user input at the earpiece. The skin touch may be a touch of an ear of a user of the earpiece. The method may further include classifying the skin touch as a type of skin touch.

DETAILED DESCRIPTION

Figure 1:
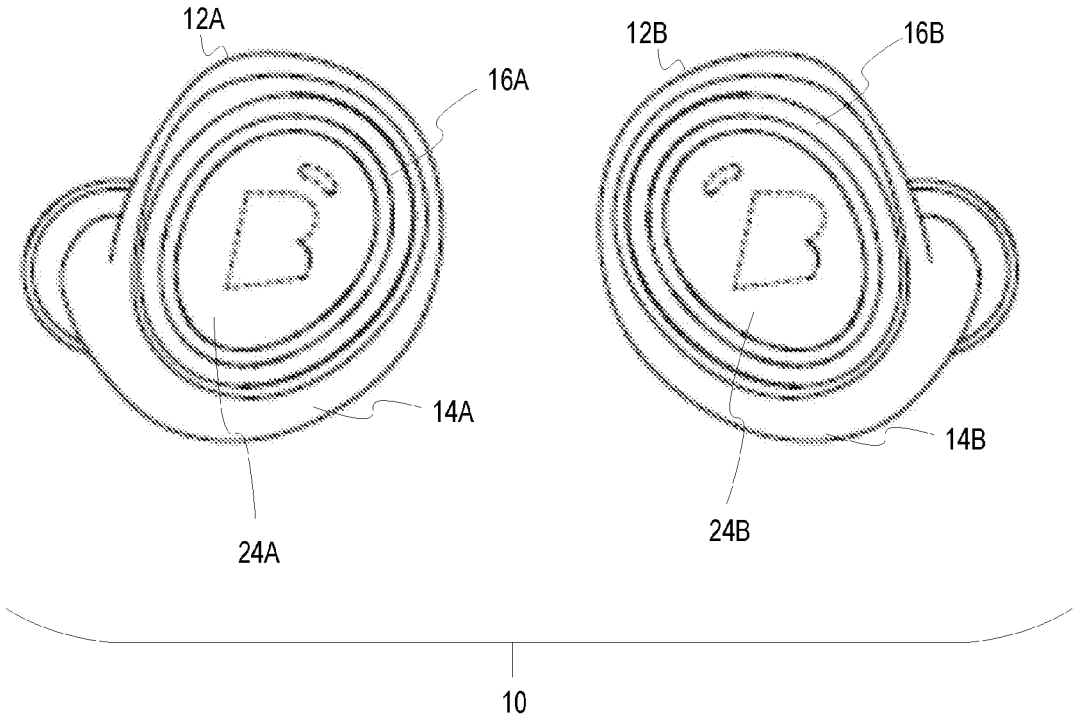
FIG. 1 illustrates a set of earpieces with a touch based interface.

The present invention relates to using wearable devices to sense touch such as the touching of the skin of the human body. FIG. 1 illustrates one example. As shown in FIG. 1, the wearable device is an earpiece. The earpiece includes one or more sensors configured to sense when the individual touches the skin or other area proximate to or within range of the earpiece.

Various types of sensors may be used. Generally, a set of emitters and detectors may be used in order to determine a change in a field associated with a touch. In one embodiment, infrared LEDs may be used. According to one aspect, touching on the skin proximate to an earpiece may provide for providing user input to the earpiece such as taps, double taps, triple taps, holds, and swipes of various directionalities. This may be advantageous over touching the earpiece itself which may affect the fit of the earpiece to the ear or possibly create minor discomfort and limit the area within which the input is received. In addition, it may be more natural and intuitive to an individual to touch their skin as opposed to the earpiece. There are numerous other advantages. For example, the area being touched may be expanded beyond the relatively small area available on an earpiece. Thus, more types of movements or touches may be detected. This may include multi-touches such as multi-touches with multiple fingers. The movements may include pinches, taps, drifts, soft touches, strokes, chordic touches (multiple fingers in a particular sequence), and other types of touches.

Because the skin or body may be touched, more natural types of touches may be performed. This may also include multiple hands, especially where there are sensors on more than one wearable device, such as with left and right earpieces. This also may include gestures close to but not touching the skin. For example, one or more hands may be shaken. One or more hands may hide all or a portion of the face, one or more hands may move side to side, up and down, rotate, or any number of other hand and/finger movement combinations. Because of the natural use of hands for expression, a more natural user interface may be provided to communicate with the device.

In addition, these various hand or finger movements may be sensed not only for directly communicating with the device, but also for the wearable device to gain insight into actions or even emotions of a user. For example, a person rubbing their eyes, putting their hand in their mouth or ear, or nose may be indicative of a medical condition or medical need. The wearable device may sense and characterize these movements so that the device may take appropriate actions such as providing audio feedback to the user or storing the data for later reporting. These characterizations may be performed in any number of ways. For example, these characterizations may be performed by a statistical analysis of the movements, the characterizations may be based on comparisons of the movements to movements within a library of movements and their characterizations. The library may be built based on a number of different users, or may be built based on a training mode in which the user confirms the characterization of different movements. Of course, any number of other analyses or models may be used including those using fuzzy logic, genetic algorithms, neural networks, or other types of analysis.

The sensors may be placed in any number of positions on the body or on peripherals. This may include being placed on earpieces, articles of clothing, articles of jewelry, or otherwise. The sensors may be used to not only detect skin touch of the user but also skin touch between another individual of the user such as may occur during a handshake, a hug, a kiss, an intimate encounter or otherwise. Information from the sensors sensing skin touch may be combined with other information to provide additional user context including through information from image sensors, microphones, physiological sensors, or other types of sensors. For example, changes in impedance may be measured to assist in identifying an individual.

FIG. 1 illustrates one example of a wearable device in the form of a set of earpieces 10 including a left ear piece 12A and a right earpiece 12B. Each of the ear pieces 12A, 12B has an ear piece housing 14A, 14B which may be in the form of a protective shell or casing. A light display area 16A, 16B is present on each of the ear pieces 12A, 12B. The light generation areas 16A, 16B each provide for producing light of one or more colors.

The wearable device may be used to sense touches of the user within an area in proximity or range of the wearable device. One or more detectors or receivers 24A, 24B may also be present to detect changes in energy fields associated with gestures performed by a user. The receivers 24A, 24B in combination with one or more emitters provide a gesture based user interface.

Figure 2:
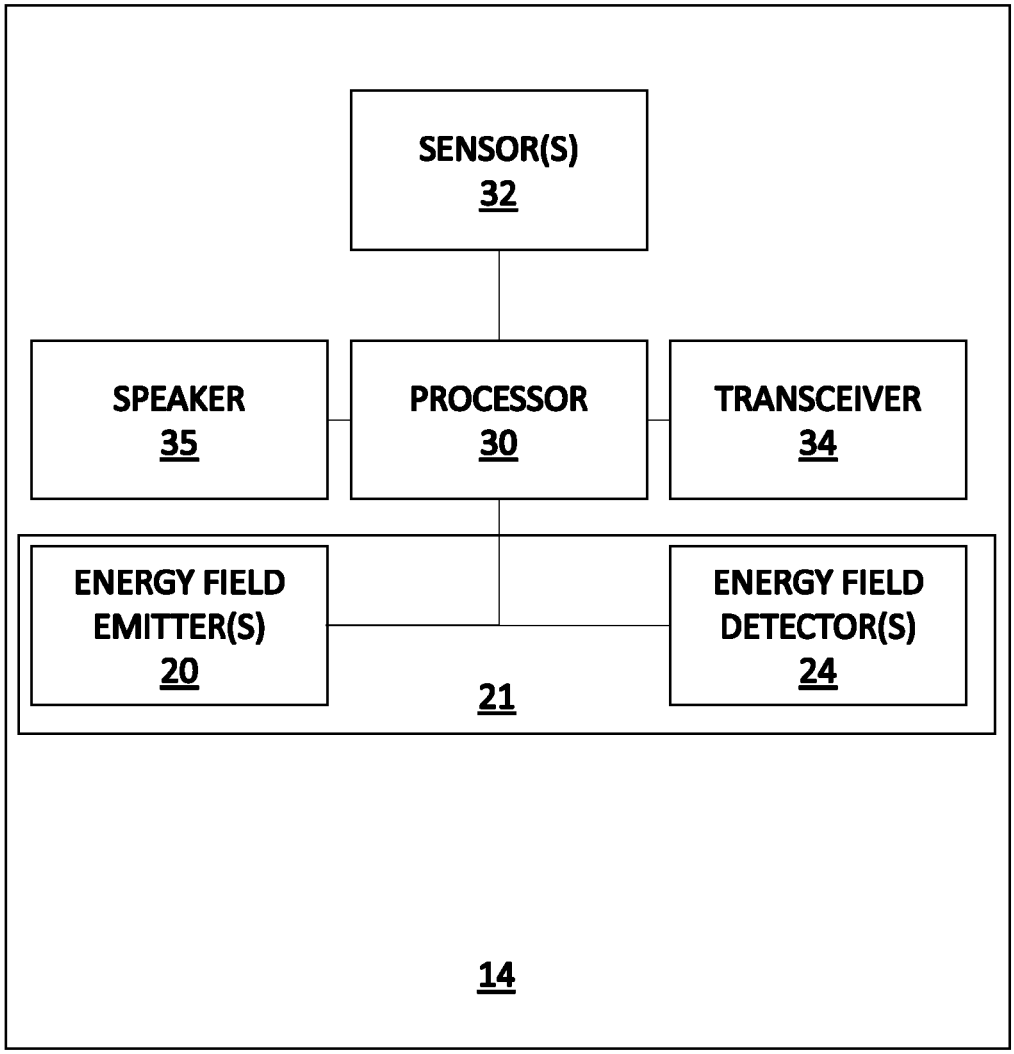
FIG. 2 is a block diagram illustrating a wearable device with a touch based interface.

FIG. 2 is a block diagram illustrating a device with a housing 14. The device may include a touch based user interface including one or more energy field emitters and one or more energy field detectors. One or more energy field emitters 20 (such as IR LEDs, other type of light emitters, ultrasound emitters, or other types of sound emitters, or other energy field emitters) may be used. The energy field emitters are operatively connected to the processor 30. It should be understood that interconnecting logic and circuits is not shown. It is to be further understood that the processor shown may include a plurality of different processors or additional circuitry. The processor 30 may also be operatively connected to one or more energy field detectors 24. The energy field detectors may be optical detectors, light detectors, sound detectors or other types of detectors or receivers and not capacitive sensors. For example, wherein the energy field emitters 20 are IR LEDs, the energy field detectors 24 may be IR receivers. The processor 30 may also be electrically connected to one or more sensors 32 (such as, but not limited to an inertial sensor, one or more contact sensors, a bone conduction sensor, one or more microphones, a pulse oximeter, or other biological sensors) and a transceiver 34 such as a short range transceiver using Bluetooth, UWB, magnetic induction, or other means of communication.

The processor 30 may also be operatively connected to one or more speakers 35. In operation, the processor 30 may be programed to receive different information using a touch-based user interface including the energy field emitter(s) 20 and the energy field detector(s) 24

The wearable device may be a wireless earpiece designed to fit into the external ear and concha cavum segment of the pinna. The system may be responsive in a number of harsh environments. These vary from complete submersion in water to being able to be accessed while wearing gloves, among others.

Figure 3:
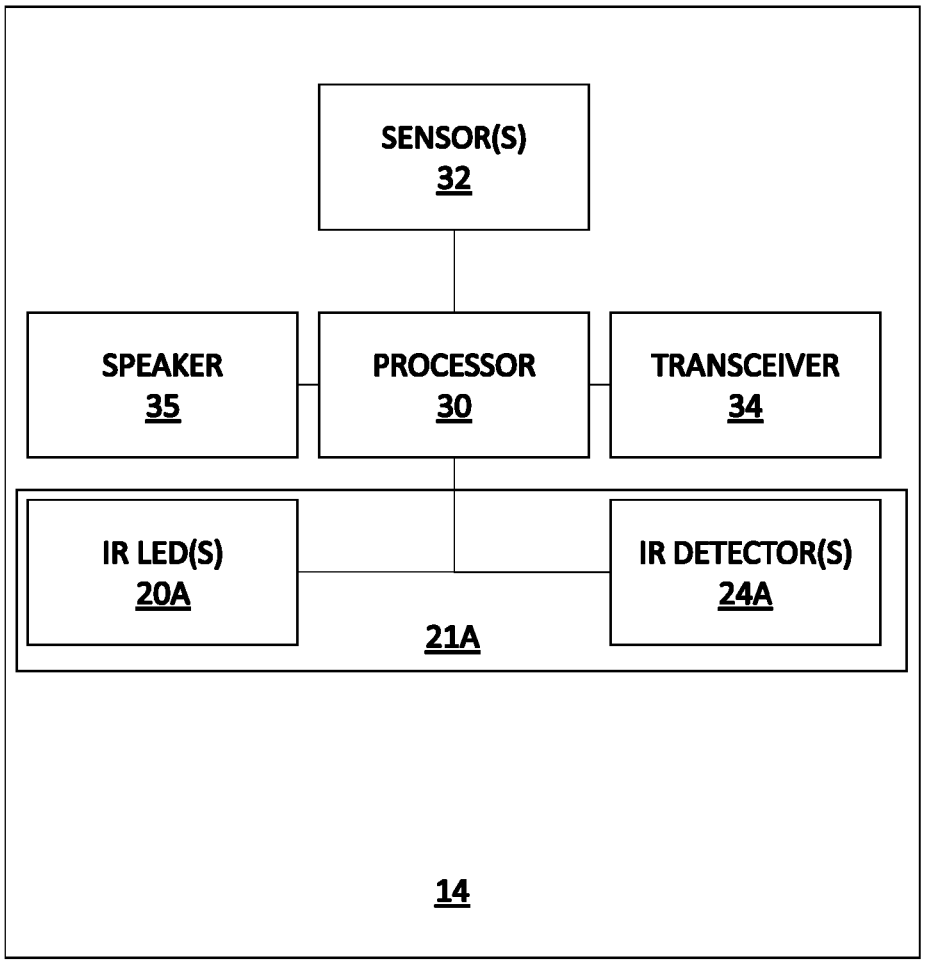
FIG. 3 is a block diagram illustrating a wearable device with an IR LED touch based interface.

As shown in FIG. 3, one embodiment utilizes an optical sensor chip as the detector 24A with associated LEDs 20A as a part of an IR LED interface 21A. These LEDs 20A are spatially segregated. The LEDs 20A are designed so that the user reflects some of the emitted light back to the sensor. If the user gets near the range of the IR, then an action is triggered. In order to allow for precise identification of signal vs. artifact, the preferred embodiment sets the IR emission at a slow rate, e.g. 100 ms intervals. When an object comes within the range of the light emitted, this then triggers an algorithm control for proximity detection. If an object is within the proximity of the one or more LED emitters, the algorithm directs the IR LED emitters to adopt a high sample rate e.g. 4 ms intervals. Reflection patterns can then be read correctly identified as touches. More than one LED emitter may be used to allow for more sophisticated touch interactions. Greater numbers, intensities, and placements of the LED emitters may be used to increase the area where touch may be sensed.

Figure 4:
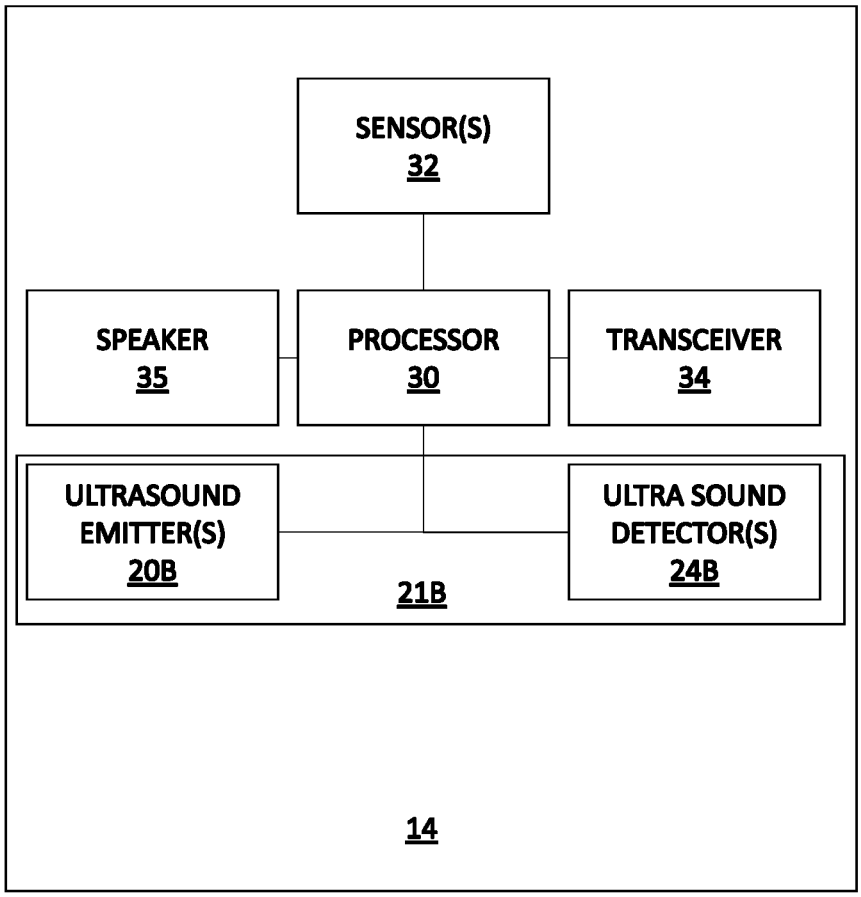
FIG. 4 is a block diagram illustrating a wearable device with an ultrasound touch based interface.
Figure 5:
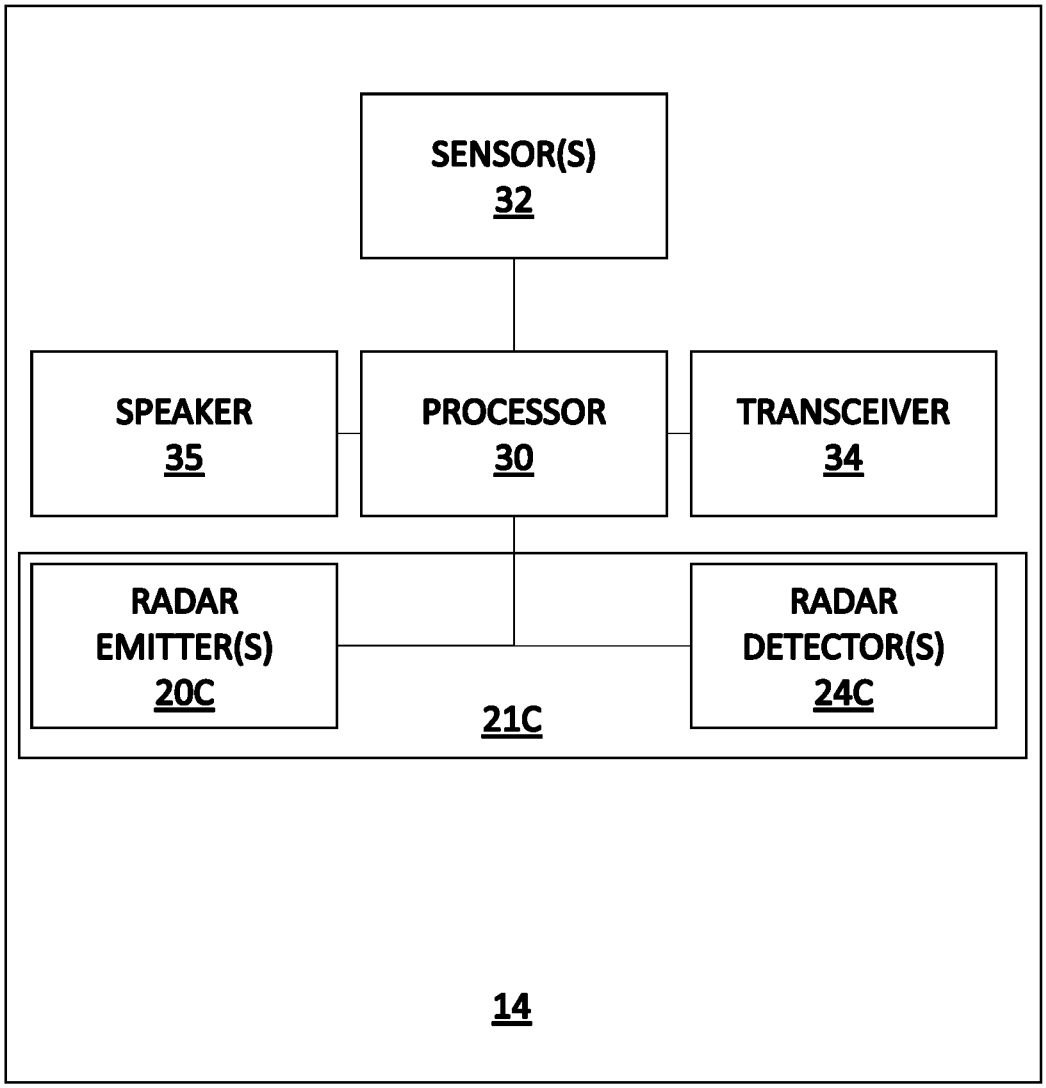
FIG. 5 is a block diagram illustrating a wearable device with a radar touch based interface.

In operation, a user may wear the ear piece. The user may touch the skin near the IR LED interface (or other type of interface). The touch may be in the form of a tap, a double tap, a triple tap, a swipe (such as a swipe with a particular directionality), a hold, or other type of touch. Note that different functionalities may be associated with different type of touches and different functionalities may be associated with the same touch when the device is operating in different modes of operation or based on the presence or absence of other contextual information. Other types of technology may be used including ultrasound emitters 20B and ultrasound detectors 24B in the touch interface 21B of FIG. 4 or radar emitters 20C and radar detectors 24C in the touch interface 21C of FIG. 5.

It is also contemplated that more than one wearable device may be used. For example, two earpieces may be used each with its own user interface. Where multiple devices are used, it is to be understood that the same gesture performed at one device may be associated with one function while the same gesture performed at the other device may associated with a different function. Alternatively, the same gesture may perform the same function regardless of which device the gesture is performed at.

It is further contemplated that haptic or audio feedback or a combination thereof may be provided to the user in response to touches made. For example, the haptic, the haptic thermal, or audio feedback may simply indicate that the touch was received or may specify the functionality associated with the touch. Alternatively, the audio feedback may request further input in the form of touches or otherwise. Alternatively, still, the audio feedback may offer a suggestion based on an interpretation of the touches such as where the touches are indicative of an emotion or physical condition, or otherwise. The haptic feedback may be in the form of pressure, heat, cold, or other sensation.

Figure 6:
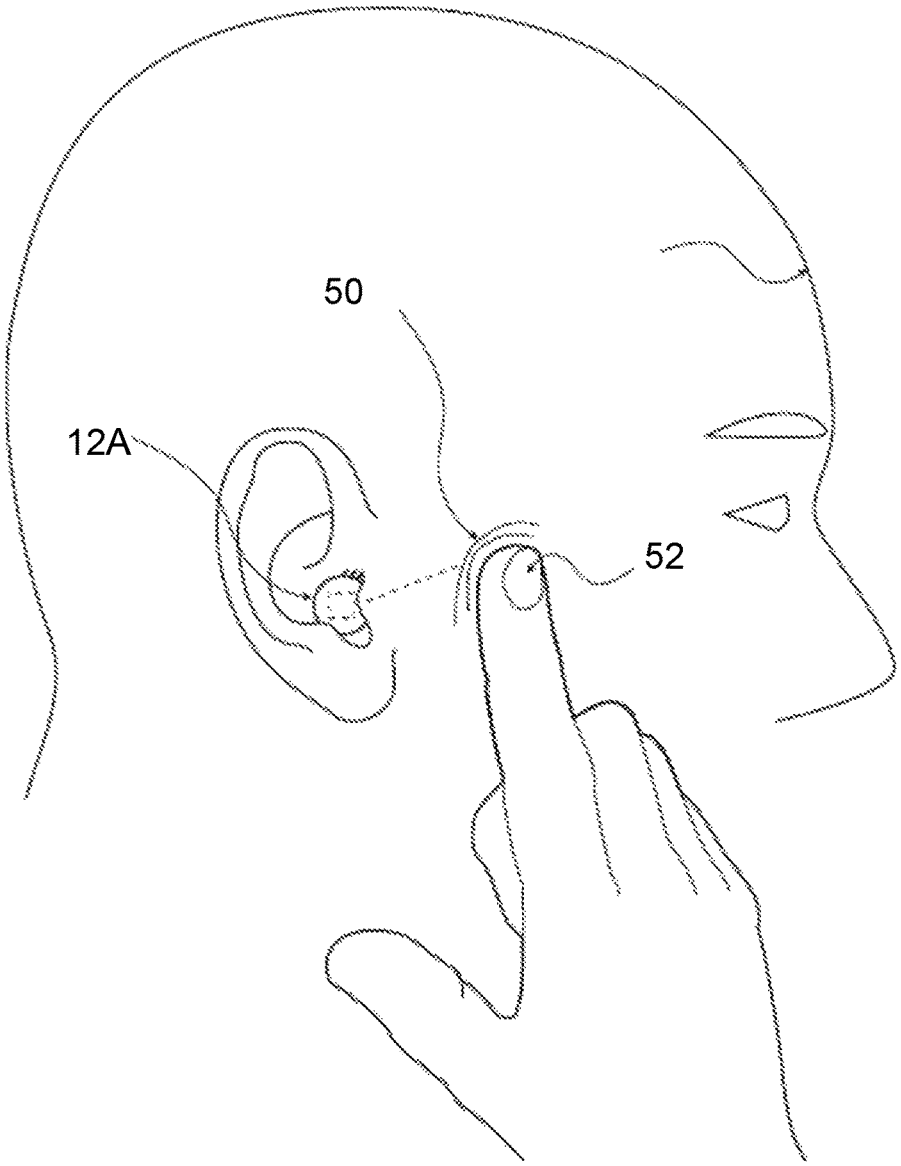
FIG. 6 illustrates an example of providing skin touch input to an earpiece.

As shown in FIG. 6, a user is wearing an earpiece 12A equipped with a sensor system for detecting touch. A user may use their finger 52 to touch an area 50 proximate the earpiece 12A. It is also contemplated that the skin surface being used may be remote from where the wearable device is worn. For example, a user may lift their hand near the earpiece and use fingers on the other hand to make motions which provide input. Thus, remote sensors may be used. The user may touch any number of different areas proximate to the wearable device. For example, where the wearable device is an earpiece 12A, the user may touch different areas on the ear. Thus, for example, stroking the posterior helical rim in an up or down fashion may be used to control volume of the earpiece or other functions. Touching the superior helical rim could advance a song forward or perform other functions. Squeezing the lobule with a thumb and pointing finger, for example, could pause or stop the current function among other actions.

Movement may be able to augment physiological sensing. Thus, for example, placing a finger anterior to the tragus would allow sensor capture of heart rate by monitoring finger movement or other movement. Another example, is that skin temperature may be determined from a finger placed near the wearable device.

Figure 7:
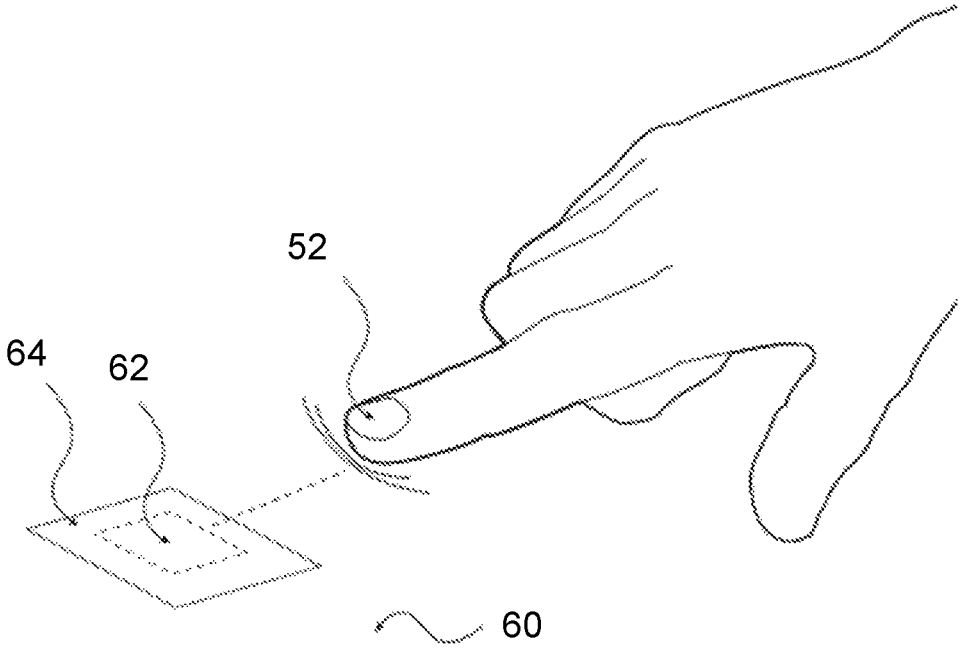
FIG. 7 illustrates an example of providing skin touch input.

As shown in FIG. 7, in a system 60, a user may touch their finger 52 at or near a wearable device 64 having a sensor system 62.

Figure 8:
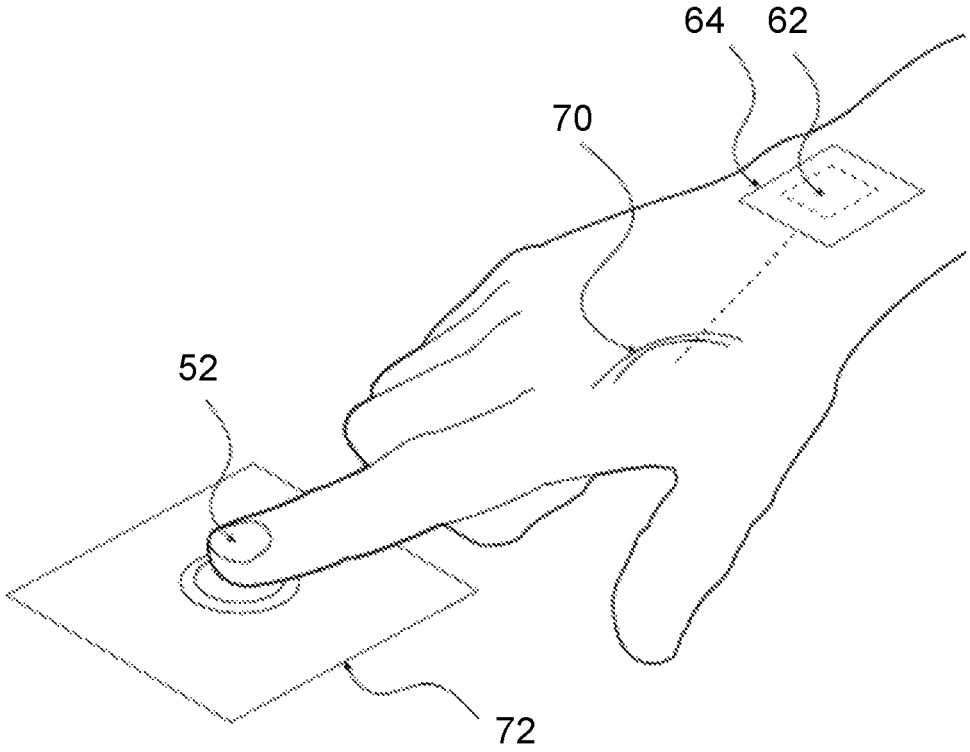
FIG. 8 illustrates another example of providing skin touch input.

As shown in FIG. 8, more than one sensor may be present. For example, a wearable device 64 with a sensor system 62 may be present on a wrist of a user such as in a watch of the user, a ring or other jewelry item, article of clothing, or other wearable. Movement of a portion of a hand 70 or finger 52 may be detected. Data detected with the wearable device 64 may be combined with data detected from other sensors such as those associated with a device 72 which is touched with a finger 52.

Figure 9:
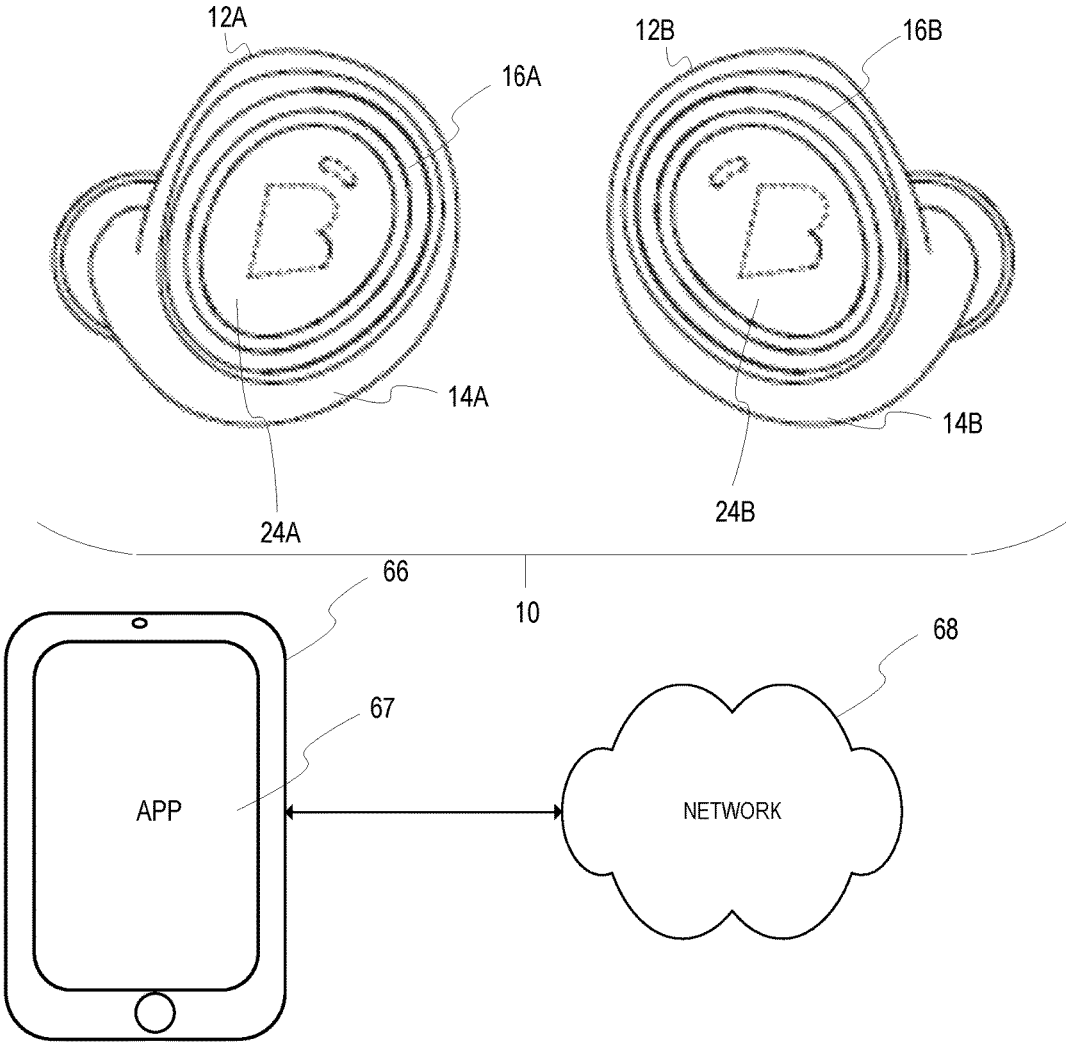
FIG. 9 illustrates a mobile app in communication with wearable devices having gesture based interfaces.

As shown in FIG. 9, user settings may be changed through the device or through other devices in operative communication with the device such as through a mobile application 67 operating on a mobile device 66 in wireless communication with one or more wearable devices 12A, 12B, each having a touch-based user interface.

Therefore, various apparatus, systems, and methods have been shown and described. Differences in the type of energy detection, the algorithms used, the gestures used, and other options, variations, and alternatives are contemplated.

What is claimed is:

1. An earpiece comprising:

an earpiece housing;

a processor disposed within the housing; and a sensor system associated with the earpiece housing, the sensor system operatively connected to the processor, wherein the sensor system comprises an emitter and a detector;

wherein the sensor system is configured to detect skin touches on skin of a user, the skin touches proximate to, but not touching, the sensor system;

wherein the processor is configured to interpret data from the sensor system to identify occurrences of the skin touches on the skin of the user.

2. The earpiece of claim 1 wherein the skin touches on the skin of the user are skin touches indicative of a user intent on an ear of the user while the earpiece is positioned within the ear.

3. The earpiece of claim 1 wherein the earpiece comprises a speaker and wherein the earpiece provides audio feedback through the speaker in response to the skin touches.

4. The earpiece of claim 1 wherein the processor interprets the skin touches as indicative of a medical condition.

5. The earpiece of claim 1 wherein the skin touches are by a person other than the user of the earpiece.

6. The earpiece of claim 1 wherein the skin touches are associated with physiological measurements.

7. The earpiece of claim 1 wherein the sensor system is further configured to detect gestures proximate the earpiece housing, the gestures not touching the skin of the user of the earpiece.

8. A method for receiving user input at an earpiece, the method comprising:

emitting energy from the earpiece;

detecting reflections of the energy at the earpiece;

analyzing the reflections by a processor of the earpiece to determine occurrences of at least one finger touch on skin of a user, the skin touch proximate to, but not touching, the earpiece; and using the skin touch to provide the user input at the earpiece.

9. The method of claim 8 wherein the skin touch on the skin of the user is a skin touch on an ear of the user of the earpiece, the skin touch indicative of a user intent.

10. The method of claim 8 further comprising classifying the skin touch on the skin of the user as a type of skin touch.

11. An earpiece comprising:

an earpiece housing;

a processor disposed within the housing;

an optical emitter operatively connected to the processor; and an optical detector operatively connected to the processor;

wherein the optical emitter and the optical detector are positioned to detect skin touches made by a person on their skin, the skin touches proximate to, but not touching, the earpiece housing;

wherein the processor is configured to analyze optical sensing data to determine occurrence of the skin touches made by the user on their skin, the skin touches proximate to, but not touching the earpiece housing, the optical emitter and/or the optical detector.

12. The earpiece of claim 11 wherein the earpiece comprises a speaker and wherein the earpiece provides audio feedback through the speaker in response to the skin touches.

13. The earpiece of claim 11 wherein the processor interprets the skin touches as indicative of a medical condition.

14. The earpiece of claim 11 wherein the person is not a user of the earpiece.

15. The earpiece of claim 11 wherein the skin touches are associated with physiological measurements.

16. An earpiece comprising:

an earpiece housing;

a processor disposed within the housing; and a sensor system associated with the earpiece housing, the sensor system operatively connected to the processor;

wherein the sensor system is configured to detect skin touches proximate the earpiece housing;

wherein the processor provides for interpreting the skin touches; and wherein the processor interprets the skin touches as indicative of an emotion.

17. An earpiece comprising:

an earpiece housing;

a processor disposed within the housing;

an optical emitter operatively connected to the processor; and an optical detector operatively connected to the processor;

wherein the optical emitter and the optical detector are positioned to detect skin touches made by a person, the skin touches proximate to the earpiece housing;

wherein the processor provides for interpreting the skin touches; and wherein the processor interprets the skin touches as indicative of an emotion.

* * * * *